US005873624A

United States Patent [19]

Simpson

[11] Patent Number: 5,873,624

[45] Date of Patent: Feb. 23, 1999

[54] FOLDING LAWN CHAIR WITH TRAY

[76] Inventor: Rick J. Simpson, 2151 E. Southern Ave., Apt. #1012, Mesa, Ariz. 85204

[21] Appl. No.: 753,847

[22] Filed: Dec. 2, 1996

[51] Int. Cl.[6] ..... A47C 4/28

[52] U.S. Cl. ..... 297/45; 297/452.2; 297/440.11; 297/184.16; 297/173

[58] Field of Search ..... 297/452.2, 440.11, 297/45, 171, 173, 188.2, 188.18, 184.16

[56] References Cited

U.S. PATENT DOCUMENTS

| | | | |
|---|---|---|---|
| 1,756,351 | 4/1930 | Hayes | 297/45 X |
| 1,925,246 | 9/1933 | Hayes | 297/45 |
| 3,042,467 | 7/1962 | Germick | 297/188.18 X |
| 4,105,244 | 8/1978 | Colby | 297/45 |
| 4,188,065 | 2/1980 | Meeker | 297/440.11 X |
| 4,566,731 | 1/1986 | Marchesini | 297/440.11 X |
| 5,180,208 | 1/1993 | Lawandi | 297/440.11 |
| 5,255,954 | 10/1993 | Rogers | 297/184.16 X |
| 5,458,395 | 10/1995 | Skarda, Jr. | 297/173 X |
| 5,507,548 | 4/1996 | Marhefka | 297/45 |
| 5,570,928 | 11/1996 | Staunton et al. | 297/45 X |

*Primary Examiner*—Milton Nelson, Jr.

[57] ABSTRACT

A folding lawn chair with tray including a left support member and a right support member. Each support member has a first end, a second end and four bends that form two upper bends, a front lower bend and a rear lower bend. The front lower bend and the rear bend, of each support member, have a linear portion therebetween for resting on a receiving surface. A pair of long bars are coupled to the left support member. A pair of short bars are coupled to the right support member. A tray is fixedly attached to the long bars when they are the coupled to the left support member. Included are a pair of sheets, with one sheet positionable over the first end of each support member and another sheet having a first and second pass through. A pair of tubular members are positioned within the first and second pass through. A pair of cross-bars being positioned between the left and right support members. Each cross-bar is coupled to the long bar of the left support member and the short bar of the right support member. Lastly, a plurality of bracket members with two of the plurality of brackets coupled to the linear portion of each of the support members and a bottom end of each cross-bar for coupling the support members and cross-bar to form a chair.

6 Claims, 3 Drawing Sheets

FIG 3
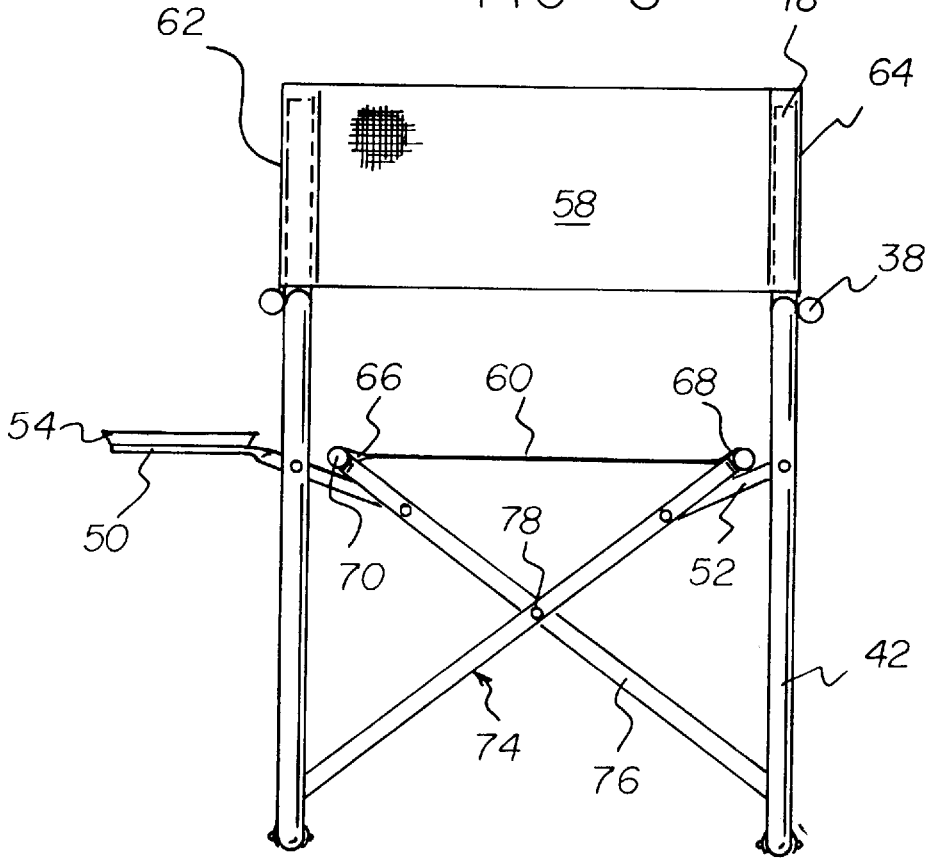
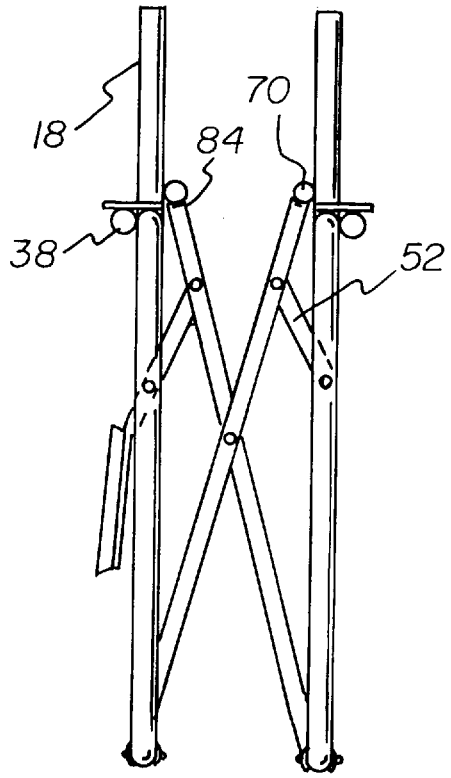
FIG 4

FIG 5
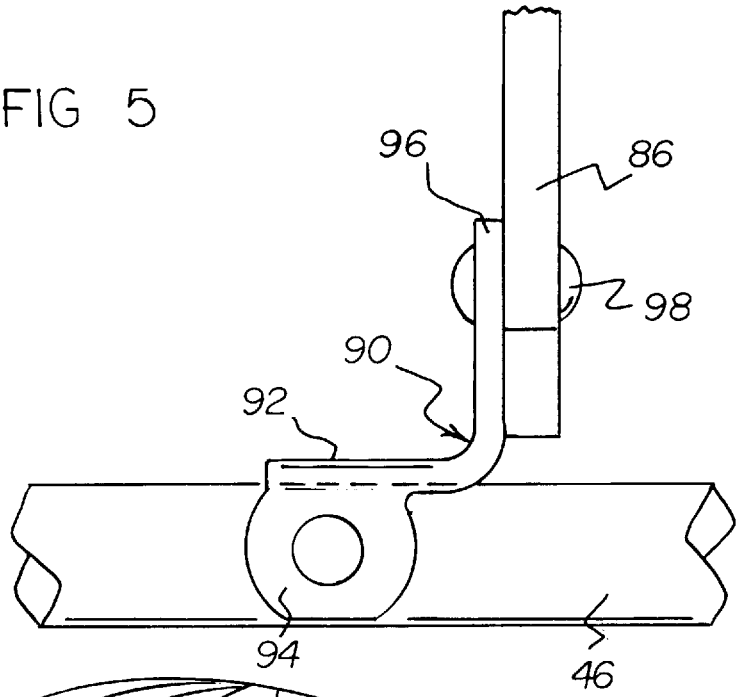
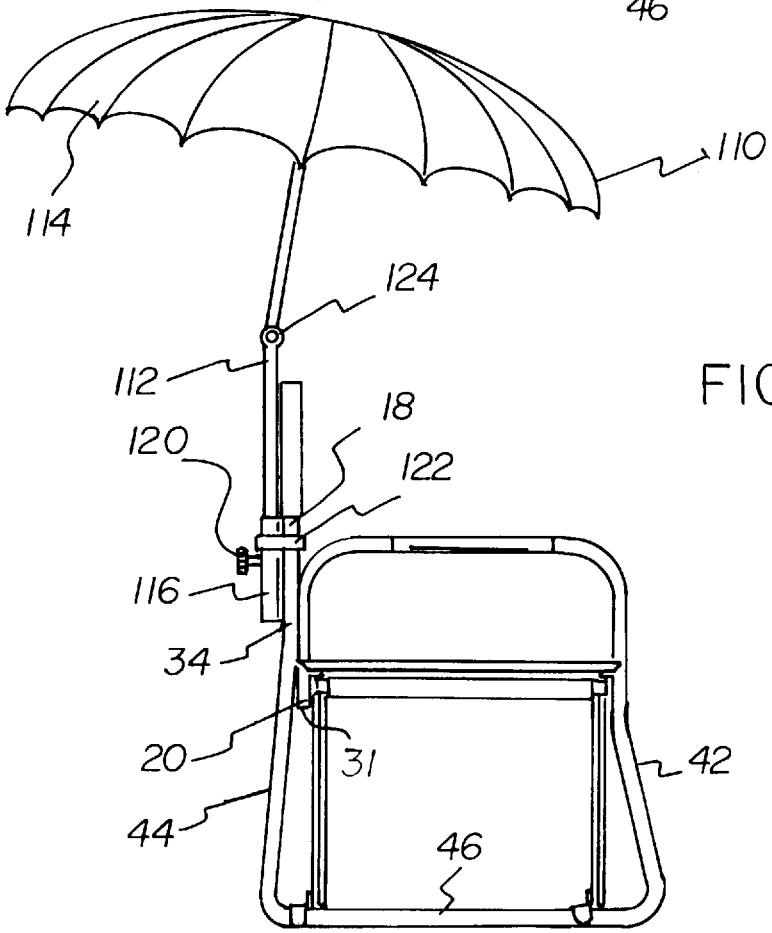
FIG 6

FOLDING LAWN CHAIR WITH TRAY

BACKGROUND OF THE INVENTION

1. Field of the Invention

The present invention relates to a folding lawn chair with tray and more particularly pertains to providing a lawn chair that is portable and further has a collapsible tray attached to one of the support members.

2. Description of the Prior Art

The use of a lawn chair is known in the prior art. More specifically, lawn chairs heretofore devised and utilized for the purpose of sitting outside are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,251,956 to Hofmeyer discloses a foldable table attachment for a collapsible chair. U.S. Pat. Des. No. 346,516 to D'Anna et al. discloses an attachable lawn chair table. U.S. Pat. Des. No. 299,991 to Hershberger discloses a table attachment for folding chair. U.S. Pat. No. 4,591,206 to Pribble discloses a table attachment for chairs. U.S. Pat. No. 4,392,685 to Leonhart discloses a combined lawn chair and table recliner. Lastly, U.S. Pat. No. 3,894,496 to Phillips and Shipley discloses a folding lawn chair table.

While these devices fulfill their respective, particular objectives and requirements, the aforementioned patents do not describe folding lawn chair with tray that has a lawn chair with a tray attached that folds in and out while the tray collapses with the folding of the chair.

In this respect, the Folding lawn chair with tray according to the present invention substantially departs from the conventional concepts and designs of the prior art, and in doing so provides an apparatus primarily developed for the purpose of providing a lawn chair that is portable and further has a collapsible tray attached to one of the support members.

Therefore, it can be appreciated that there exists a continuing need for a new and improved Folding lawn chair with tray which can be used for providing a lawn chair that is portable and further has a collapsible tray attached to one of the support members. In this regard, the present invention substantially fulfills this need.

SUMMARY OF THE INVENTION

In view of the foregoing disadvantages inherent in the known types of lawn chairs now present in the prior art, the present invention provides an improved Folding lawn chair with tray. As such, the general purpose of the present invention, which will be described subsequently in greater detail, is to provide a new and improved folding lawn chair with tray and method which has all the advantages of the prior art and none of the disadvantages.

To attain this, the present invention essentially comprises a pair of peripheral support members that forming a left support member and a right support member. The left and right support members each have a first end, a second end and four bends. The four bends have formed two upper bends, a front lower bend and a rear lower bend. Each support member has a curve spaced from the rear lower bend and adjacent first end for forming a back frame member onto each support member. The second end of each support member is coupled to the back frame member and forms an armrest between the two upper bends. The front lower bend and one of the upper bends of the left and right support members each have a front vertical portion. The front lower bend and the rear bend of each support member has a linear portion therebetween for resting on a receiving surface. A pair of long flat bars are included. One of the long flat bars is pivotally coupled to the second end of the left support member. Another of the long flat bars is pivotally coupled to the front vertical portion of the left support. Provided are a pair of short flat bars. One of the short flat bars are pivotally coupled to the second end of the right support member. Another of the short flat bars is pivotally coupled to the front vertical portion of the right support member. A generally rectangular tray is fixedly attached to the long bars of the left support member. A pair of generally rectangular sheets are included. The sheets form a top sheet and a bottom sheet. The top sheet is capable of receiving one first end of each of the pair of support members. The bottom sheet has a first and second pass through. Also, a pair of elongated tubular members are included. One each of the tubular members is positioned within the first and second pass through of the bottom sheet. A pair of cross-bars with each being formed by a pair of elongated bars. The pair of elongated bars of each cross-bar are pivotally coupled about a center point. The pair of cross-bars are positioned between the left and right support members. Each elongated bar has a top end coupled with one of the tubular members and a bottom end. One of the elongated bars of each cross-bar is coupled to the long flat bar of the left support member. Another of the elongated bars coupled to the short flat bar of the right support member. The top end of each cross-bar is coupled with opposite tubular members to form an 'X' shape when each cross-bar is in an open position between the pair of support members. Lastly, a plurality of bracket members are included. Each bracket member has a central extent with a wing portion a vertical extent. Two of the plurality of brackets have each wing portion coupled to the linear portion of each of the support members, with each vertical extent rotatably coupled to the bottom end of each cross-bar. The plurality of brackets couple the pair of support members with the pair of cross bars to form a chair that has the top sheet for back support and the bottom sheet for a seat. The chair is capable of folding and closing about the cross-bars with the tray raising and lowering in conjunction therewith.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved folding lawn chair with tray which has all of the advantages of the prior art Lawn chairs and none of the disadvantages.

It is another object of the present invention to provide a new and improved folding lawn chair with tray which may be easily and efficiently manufactured and marketed.

It is further object of the present invention to provide a new and improved folding lawn chair with tray which is of durable and reliable constructions.

An even further object of the present invention is to provide a new and improved folding lawn chair with tray which is susceptible of a low cost of manufacture with regard to both materials and labor, and which accordingly is then susceptible of low prices of sale to the consuming public, thereby making such folding lawn chair with tray economically available to the buying public.

Even still another object of the present invention is to provide a folding lawn chair with tray for providing a lawn chair that is portable and further has a collapsible tray attached to one of the support members.

Lastly, it is an object of the present invention to provide a new and improved folding lawn chair with tray including a pair of peripheral support members forming a left support member and a right support member. Each support member has a first end, a second end and four bends that form two upper bends, a front lower bend and a rear lower bend. The front lower bend and the rear bend, of each support member, have a linear portion therebetween for resting on a receiving surface. A pair of long bars are coupled to the left support member. A pair of short bars are coupled to the right support member. A tray is fixedly attached to the long bars when they are coupled to the left support member. Included are a pair of sheets, with one sheet positionable over the first end of each support member and another sheet having a first and second pass through. A pair of tubular members are positioned within the first and second pass through. A pair of cross-bars being positioned between the left and right support members. Each cross-bar is coupled to the long bar of the left support member and the short bar of the right support member. Lastly, a plurality of bracket members with two of the plurality of brackets coupled to the linear portion of each of the support members and a bottom end of each cross-bar for coupling the support members and cross-bar to form a chair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a frontal view of the chair of the present invention in an opened and operable orientation.

FIG. 4 is a frontal view of the chair of the present invention in a closed orientation.

FIG. 5 is an enlarged cut-away view of a bracket of the present invention.

FIG. 6 is a side view of the present invention with an umbrella attachment.

The same reference numerals refer to the same parts through the various Figures.

DESCRIPTION OF THE PREFERRED EMBODIMENT

Figure 1:
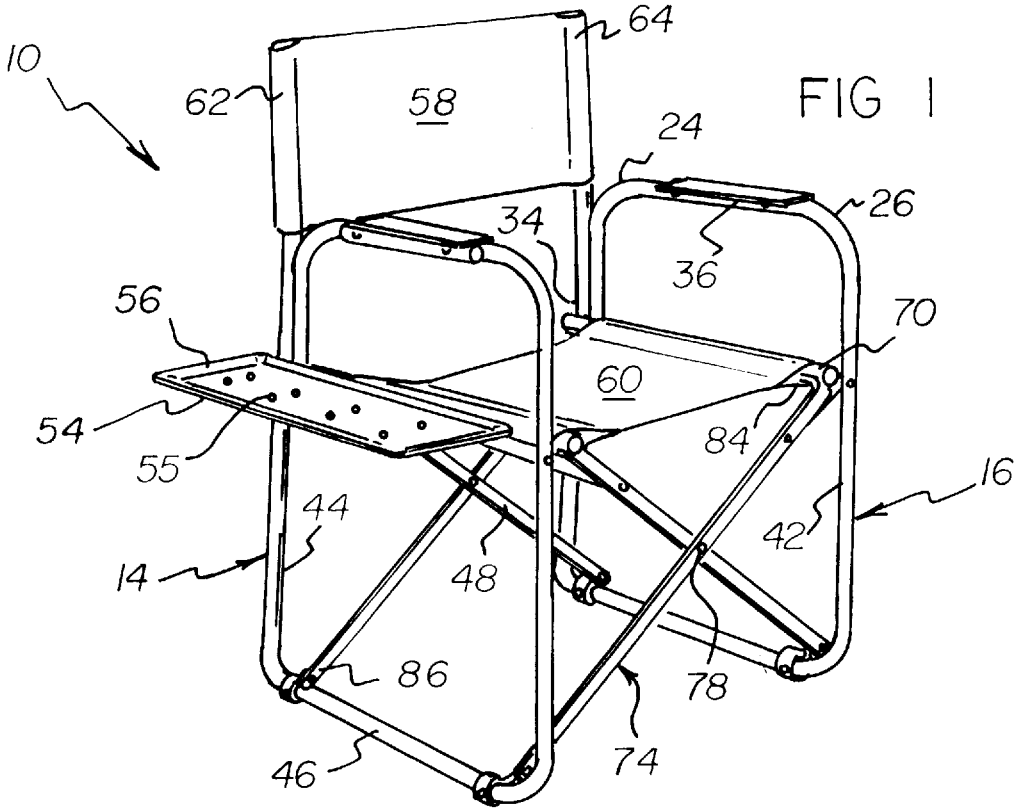
FIG. 1 is a perspective view of the preferred embodiment of the folding lawn chair with tray constructed in accordance with the principles of the present invention.

With reference now to the drawings, and in particular to FIG. 1 thereof, the preferred embodiment of the improved folding lawn chair with tray embodying the principles and concepts of the present invention and generally designated by the reference numeral 10 will be described.

The present invention, the folding lawn chair with tray 10 is comprised of a plurality of components. Such components in their broadest context include a lawn chair and a tray. Such components are individually configured and correlated with respect to each other so as to attain the desired objective.

Figure 2:
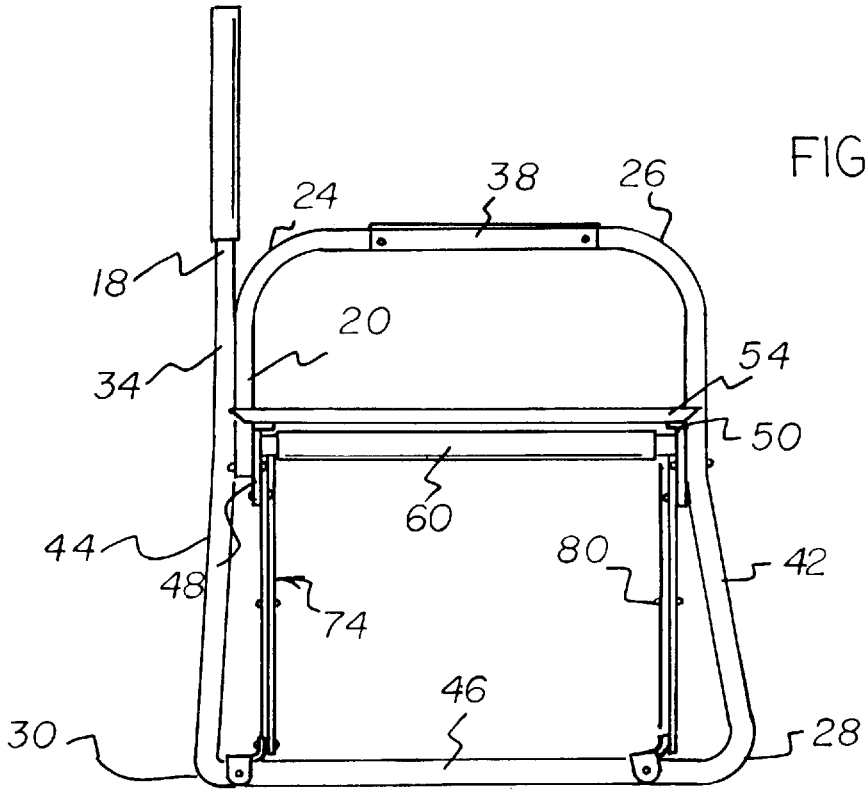
FIG. 2 is a side elevational view of the present invention of FIG. 1.

Specifically, the present invention includes a pair of peripheral support members that form a left support member 14 and a right support member 16. The left and right support member each having a first end 18, a second end 20 and four bends 24, 26, 28, and 30. The four bends having formed two upper bends 24 and 26, a front lower bend 28 and a rear lower bend 30. As seen in FIG. 2, the two upper bends and the front lower bend having equivalent bend radius. The support members are formed of tubular aluminum and has a plastic end cap positioned over each tubular end 31.

Also, the front lower bend 28 is shown to having a smaller bend radius than the bend radius of the rear lower bend 30. The small bend radius of the front bend of the left and right support member provides stability to the support members when positioned on a receiving surface.

Additionally, each support member has a curve 34 that is spaced from the rear lower bend 30 and adjacent the first end 18. The curve of the left and right support members form a back frame member 18 onto each support member. Note that the back frame member and the top end are the same structure. The second end 20 of each support member 14 and 16 is coupled to the back frame member to have an armrest support 36 formed between the two upper bends.

Attached to the armrest of the left and right support member is a plastic arm member 38. As seen in FIG. 3, the plastic arm member adds additional width to the armrest support for arm comfort and support. The plastic arm member reduces the likelihood of metal heated in the sun burning the arm of the chair user. The front lower bend 28 and one of the upper bends, of the left and right support members, each have a front vertical portion 42. The rear lower bend 30 and the curve 34, of the left and right support members, each have a rear vertical portion 44. The front lower bend and the rear bend of each support member has a linear portion 46 therebetween for resting on a receiving surface.

Included are a pair of long flat bars 48. One of the long flat bars is pivotally coupled to the second end 20 of the left support member 14, as shown in FIG. 2. Another of the long flat bars is pivotally coupled to the front vertical portion 42 of the left support, as seen in FIG. 1. Each long flat bar extends beyond the support member to have a free end 50. The long flat bar is twisted to allow the flat surface of the free end lie in a horizontal plane. In addition to the pair of long flat bars, a pair of short flat bars 52 are provided. One of the flat bars is pivotally coupled to the second end 20 of the right support member. As depicted in FIG. 3, another of the short flat bars is pivotally coupled to the front vertical portion of the right support member 42.

A generally rectangular tray 54 is fixedly attached to the free end 50 of each long flat bars 48 of the left support member 14. The tray has a non-slip plastic coating on the top surface, drain holes 55 and a peripheral rim 56. This provides a support for various items.

As best illustrated in FIG. 1, a pair of generally rectangular sheets are provided. The pair of sheets are canvas. The pair of sheets form a top sheet 58 and a bottom sheet 60. The top sheet having a first end pocket 62 and second end pocket 64. As seen in FIG. 3, the first and second end pocket of the top sheet are capable of receiving one first end 18 of each of the pair of support members. On the lower portion of the top sheet, on the left side and the right side, there is a snap. On the first end of the left and right support member is a receiving snap. The snaps of the top sheet correspond to the receiving snap on the left and right support member for coupling. The bottom sheet has a first pass through 66 and second pass through 68. The bottom sheet has a larger diameter than the top sheet. The bottom sheet may come with an additional pouch. The pouch, not shown, would have an open end at the front of the chair and be sealed at the rear left and right side of the bottom sheet. The open end of the pouch may have pile-type fasteners for closing the pouch.

The top sheet may have a small flap at the bottom of the top sheet with a snap that corresponds to the receiving snap on the left and right support end. The top sheet may further be improved by attaching a second smaller sheet on the back side of the top sheet to form an additional pouch. The bottom, left and right sides of the smaller sheet are sewn to the back side of the top sheet to leave the top end open to receive cushions or publications.

A pair of elongated tubular members 70 are included. One each of the tubular members is positioned within the first and second pass through of the bottom sheet. FIG. 3 shows the tubular members within the pass through of the bottom sheet.

The present invention includes a pair of cross-bars 74. Each cross-bar is formed by a pair of elongated bars 76 pivotally coupled about a center point 78 with a rivet 80. The pair of cross-bars are positioned between the left support member 14 and right support 16 member. Each elongated bar has a top end 84 and a bottom end 86. Each top end of each elongated bar is curved in order to couple with one of the tubular members. One of the elongated bars of each cross-bar is coupled to the long flat bar 48 of the left support member 14, while another of the elongated bars is coupled to the short flat bar of the right support member 16. The top end of each cross-bar is coupled to opposite tubular members to form an 'X' shape when each cross-bar is in an open position between the pair of support members.

Lastly, a plurality of bracket members 90 are provided. Two of the plurality of brackets are coupled to each of the support members as shown in FIG. 1. Each bracket member, as seen in FIG. 5, has a central member 92. The central member has a wing portion 94 and an extent 96. Each wing portion is wrapped around the linear portion 46 of the left support member and right support member. Each wing is fixedly attached to the linear portion. Each extent is rotatably coupled to the bottom end of the elongated bar of each cross-bar with a pivot pin 98. The plurality of brackets are capable of coupling the pair of support members with the pair of cross bars to form a chair, with the top sheet for back support and the bottom sheet for a seat. The chair 10 is capable of folding and closing about the cross-bars with the tray 54 raising and lowering in conjunction therewith.

Furthermore, the chair of the present invention may come with an umbrella attachment 110. As shown in FIG. 6, the umbrella attachment has an elongated rod 112, a bonnet 114 and a receiving tube 116. The receiving tube has an adjustment handle 120 threadedly positioned within the tube. The receiving tube of the umbrella attachment is clamped to the top end 18 of either the left support member 14 or the right support member 16 with a bracket 122. The elongated rod is pivotable back and forth about a pivot point 124. The bonnet of the umbrella attachment is opened and closed in the standard manner.

Finally, the elongated rod 112 is positioned within the receiving tube 116 when the tube is coupled to top end of one of the support members 14 or 16. The height of the elongated rod is adjusted within the receiving tube and locked in place by the adjustment handle. The umbrella attachment is used to provide shade to the chair 10 user. When the user leaves the chair, chair stakes (not shown) may be provided. The chair stakes will have the shape of an inverted 'J' and will hold the chair down.

The folding lawn chair with tray of the present invention features a comfortable canvas seat and back. The components of the chair and tray are aluminum. The chair may come with a convenient side pouch for carrying various items. The tray has an etched plastic coating on the top surface to prevent slipping of glasses. The tray has eight drain holes to drain spills and condensation runoff. The tray has a peripheral rim to prevent pens and pencils from rolling off of the tray. Also, the tray may have a plurality of male snaps on an underside. The male snaps are used to couple with female snaps of the pouch. The present invention is light weight and easy to carry. The chair is folded at the cross-bars for easy storage. When the chair is folded closed the tray folds down to lie against the left support member. The present invention may be used in any outdoor situation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An improved folding lawn chair with tray for outdoor use comprising in combination:

a pair of peripheral support members forming a left support member and a right support member, the left and right support member each having a first end, a second end and four bends therebetween, the four bends having formed two upper bends, a front lower bend and a rear lower bend, each support member having a curve spaced from the rear lower bend and adjacent first end for forming a back frame member onto each support member, the second end of each support member being coupled to the back frame member for forming an armrest between the two upper bends, the front lower bend and one of the upper bends of the left and right support members each having a front vertical portion therebetween, the front lower bend and the rear bend of each support member having a linear portion therebetween for resting on a receiving surface;

a pair of long flat bars, one of the long flat bars being pivotally coupled to the second end of the left support member with another of the long flat bars being pivotally coupled to the front vertical portion of the left support member;

a pair of short flat bars, one of the short flat bars being pivotally coupled to the second end of the right support member with another of the short flat bars being pivotally coupled to the front vertical portion of the right support member;

a generally rectangular tray being fixedly attached to the long bars of the left support member, the tray having a non-skid surface and drain holes;

a pair of generally rectangular sheets forming a top sheet and a bottom sheet, the top sheet being capable of receiving one first end of each of the pair of support members, the bottom sheet having a first and second pass through;

a pair of elongated tubular members with one each of the tubular members being positioned within the first and second pass through of the bottom sheet;

a pair of cross-bars with each being formed by a pair of elongated bars pivotally coupled about a center point, the pair of cross-bars being positioned between the left and right support members, each elongated bar has a top end coupled with one of the tubular members and a bottom end, one of the elongated bars of each cross-bar being coupled to the long flat bar of the left support member with another of the elongated bars coupled to the short flat bar of the right support member, the top end of each cross-bar being coupled with opposite tubular members to form an 'X' shape when each cross-bar is in an open position between the pair of support members; and a plurality of bracket members having a central extent with a wing portion and a vertical extent, two of the plurality of bracket members having each wing portion coupled to the linear portion of each of the support members with each vertical extent rotatably coupled to the bottom end of each cross-bar, the plurality of bracket members being capable of coupling the pair of support members with the pair of cross bars to form a chair having the top sheet for back support and the bottom sheet for a seat, the top sheet being secured by snaps on the support members and the top sheet, the bottom sheet having a smaller sheet sewn on the back, left and right sides to form a pouch on the underside of the bottom sheet, the chair capable of folding and closing about the cross-bars with the tray raising and lowering in conjunction therewith.

2. A folding lawn chair with tray comprising:

a left support member and a right support member, each support member having a first end, a second end and four bends that form two upper bends, a front lower bend and a rear lower bend, the front lower bend and the rear bend of each support member having a linear portion therebetween for resting on a receiving surface, each support member being formed of a tubular metal with tubular ends and each tubular end being covered with a end cap;

a pair of long flat bars being coupled to the left support member;

a pair of short bars being coupled to the right support member;

a tray being fixedly attached to the long flat bars when coupled to the left support member, the tray having a non-skid surface and drain holes and the tray having male snaps attached thereto;

a pair of sheets with one sheet positionable over the first end of each support member and another sheet having a first and second pass through, the one sheet being positioned over the first end and having a smaller sheet being sewn along a left, right and bottom side of the one sheet to form a pouch;

a pair of tubular members for positioning within the first and second pass through;

a pair of cross-bars being positioned between the left and right support members, one of each cross-bar being coupled to one of the long flat bars of the left support member and one of the short bars of the right support member, and another of each cross-bar being coupled to another of the long flat bars of the left support member and another of the short bars of the right support member; and a plurality of bracket members with two of the plurality of bracket members coupled to the linear portion of each of the support members and a bottom end of each cross-bar for coupling the support members and cross-bar to form a chair.

3. The folding lawn chair with tray as set forth in claim 2, wherein each support member having a curve spaced from the rear lower bend and adjacent first end for forming a back frame member onto each support member.

4. The folding lawn chair with tray as set forth in claim 3, wherein the second end of each support member being coupled to the back frame member for forming an armrest support between the two upper bends, the armrest support having an arm member positioned thereon, the arm member providing comfort and reduction in heat transfer from the armrest support to a chair user.

5. The folding lawn chair with tray as set forth in claim 2, wherein the one sheet being a top sheet and another sheet being a bottom sheet of greater area, the top sheet having a smaller sheet attached to form the pouch, the pouch has small flaps at a bottom of each side of the top sheet, the top sheet has snaps that correspond to a receiving snap on the support member, the bottom sheet having a small sheet sewn onto an underside thereof, the smaller sheet being sewn to three sides of the bottom sheet and leaving a front side open for receiving magazines and the like.

6. The folding lawn chair with tray as set forth in claim 2, wherein the first end having an umbrella support fixture being attached by a bracket, the umbrella support fixture being adjustable.

* * * * *